US009127462B1

(12) United States Patent
Malagrida

(10) Patent No.: US 9,127,462 B1
(45) Date of Patent: Sep. 8, 2015

(54) RAINWATER GUTTER

(71) Applicant: MALAGRIDA GROUP S.r.l., Rimini (IT)

(72) Inventor: Yuri Malagrida, Rimini (IT)

(73) Assignee: MALAGRIDA GROUP S.R.L. (IT)

( * ) Notice: Subject to any disclaimer, the term of this patent is extended or adjusted under 35 U.S.C. 154(b) by 0 days.

(21) Appl. No.: 14/495,272

(22) Filed: Sep. 24, 2014

(51) Int. Cl.
*E04D 13/00* (2006.01)
*E04D 13/068* (2006.01)
*E04D 13/064* (2006.01)

(52) U.S. Cl.
CPC ..... *E04D 13/068* (2013.01); *E04D 13/064* (2013.01)

(58) Field of Classification Search
USPC ..... 52/11–13; 405/119; 285/10, 55
See application file for complete search history.

(56) References Cited

U.S. PATENT DOCUMENTS

| | | | | |
|---|---|---|---|---|
| 1,949,984 | A * | 3/1934 | Walker | 285/55 |
| 3,656,769 | A * | 4/1972 | Jelinek et al. | 285/363 |
| 4,299,171 | A * | 11/1981 | Larson | 104/70 |
| 4,457,441 | A * | 7/1984 | McCloughan | 220/4.12 |
| 5,038,528 | A * | 8/1991 | Brant | 52/11 |
| 5,226,681 | A * | 7/1993 | Smith et al. | 285/200 |
| 6,000,881 | A * | 12/1999 | Becker et al. | 405/119 |
| 6,220,784 | B1 * | 4/2001 | Bricker | 405/118 |
| 6,273,640 | B1 * | 8/2001 | Suazo | 405/121 |
| 8,104,796 | B2 * | 1/2012 | Stefani et al. | 285/55 |
| 2007/0007768 | A1 * | 1/2007 | Ho | 285/368 |
| 2008/0019776 | A1 * | 1/2008 | Fithian et al. | 405/118 |
| 2008/0095582 | A1 * | 4/2008 | Aristeo | 405/119 |
| 2009/0097921 | A1 | 4/2009 | Hetzler et al. | |
| 2009/0129853 | A1 * | 5/2009 | Pionetti | 403/23 |
| 2010/0018128 | A1 * | 1/2010 | Strandi et al. | 52/12 |

FOREIGN PATENT DOCUMENTS

| | | |
|---|---|---|
| DE | 9110816 | 12/1991 |
| DE | 202006012625 | 12/2007 |
| EP | 0928850 | 7/1999 |

OTHER PUBLICATIONS

European Search Report dated Nov. 21, 2013.

* cited by examiner

*Primary Examiner* — Brian D Mattei
(74) *Attorney, Agent, or Firm* — The Belles Group, P.C.

(57) ABSTRACT

A rainwater gutter defined by at least two channels connected end to end to each other in fluid-tight manner by a first sleeve projecting inside one of the channels, a second sleeve projecting outwards of the other channel and inserted inside the first sleeve, a first annular seal interposed between the first sleeve and the second sleeve, a second annular seal fitted between two end faces of the two channels, and fastening means for fastening the two end faces one to the other with the interposition of the second annular seal.

11 Claims, 4 Drawing Sheets

RAINWATER GUTTER

FIELD OF INVENTION

The present invention relates to a rainwater gutter.

BACKGROUND OF THE INVENTION

In the building industry, rainwater gutters are used comprising a number of elongated channels connected end to end.

Each channel extends in a given direction, has a bottom supporting face by which to mount the channel on a supporting surface, is bounded internally by a bottom wall defining a rainwater flow bed, and is bounded longitudinally by two substantially parallel end faces perpendicular to said direction.

Each channel is normally connected to each adjacent channel by a number of bolts fitted through the corresponding end faces.

Known rainwater gutters of the type described above have several drawbacks, mainly due to the way in which the adjacent channels are connected not providing for any sort of scaling, and so allowing rainwater to seep between the end faces of the adjacent channels, thus damaging the construction beneath the gutter.

SUMMARY OF THE INVENTION

It is an object of the present invention to provide a rainwater gutter designed to eliminate the above drawbacks, and which is cheap and easy to produce.

According to the present invention, there is provided a rainwater gutter as claimed in the attached Claims.

BRIEF DESCRIPTION OF THE DRAWINGS

A non-limiting embodiment of the present invention will be described by way of example with reference to the attached drawings, in which.

DETAILED DESCRIPTION OF THE INVENTION

Figure 1:
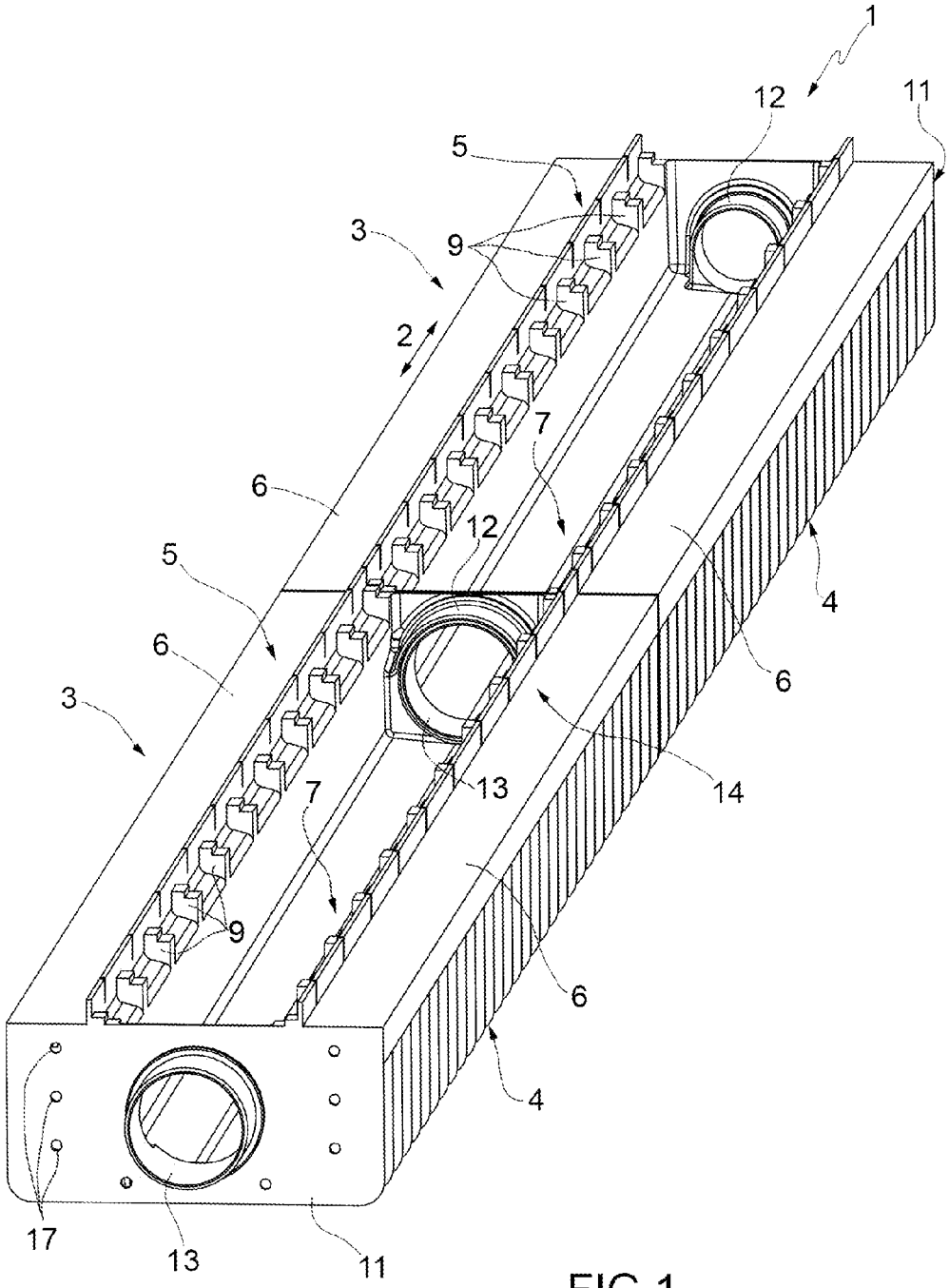
FIG. 1 shows a schematic view in perspective, with parts removed for clarity, of a preferred embodiment of the gutter according to the present invention.
Figure 2:
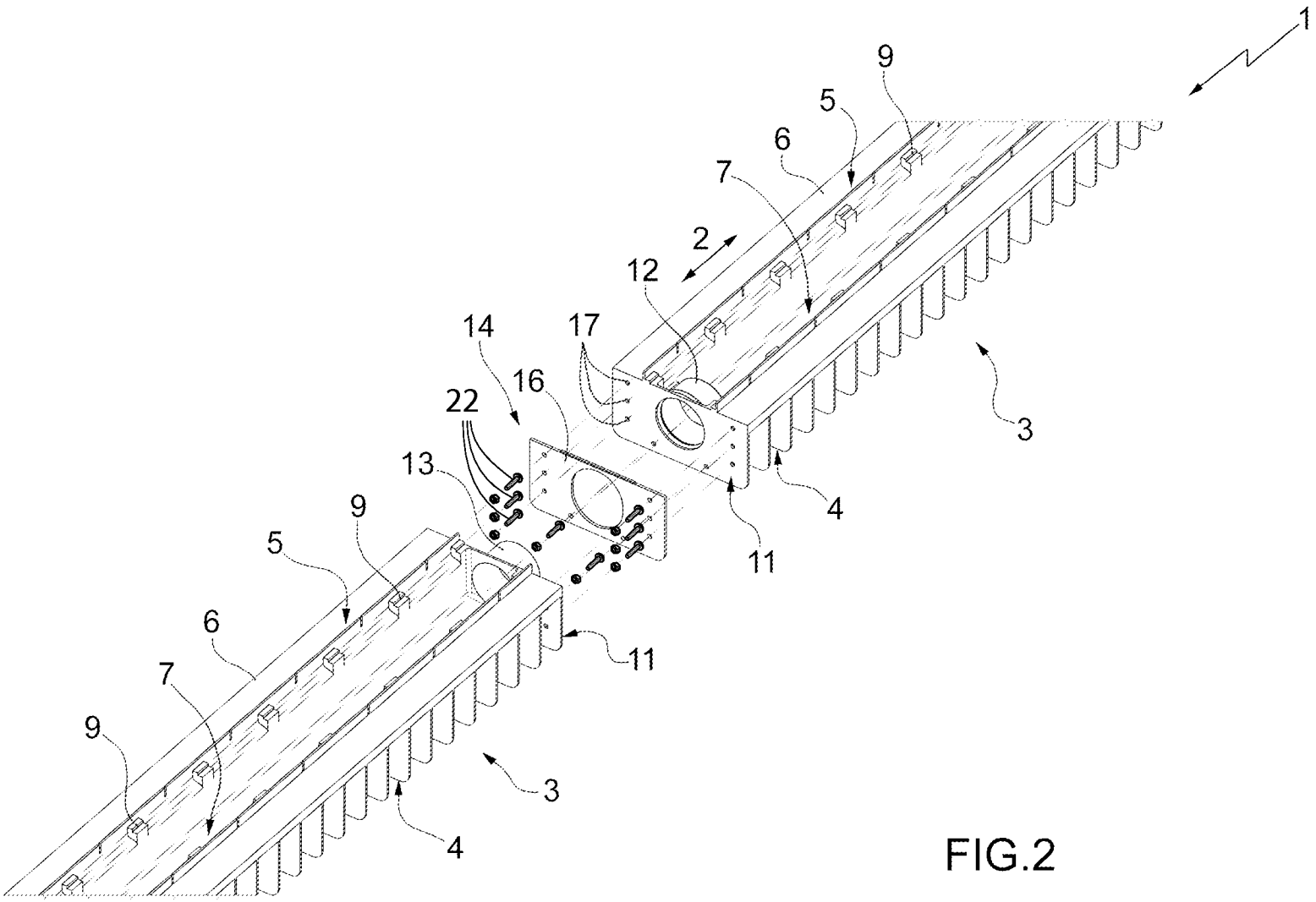
FIG. 2 shows an exploded view in perspective of the FIG. 1 gutter.

Number 1 in FIGS. 1 and 2 indicates as a whole a rainwater gutter, which extends in a direction 2 and comprises a number of elongated channels 3 (two of which shown in FIG. 1) connected end to end in direction 2.

Each channel 3 extends in direction 2, is made of plastic material, and is bounded by a bottom supporting face 4, by which to mount channel 3 on a supporting surface (not shown), and by a top face 5 substantially parallel to face 4.

The distance between faces 4 and 5, and hence the height of channel 3, are therefore substantially constant along the whole length of channel 3, thus enabling fast, easy installation of gutter 1.

Channel 3 has a substantially U-shaped cross section, is bounded by two longitudinal shoulders 6 parallel to each other and to direction 2, and is bounded internally by a bottom wall 7 defining a rainwater flow bed.

Figure 3:
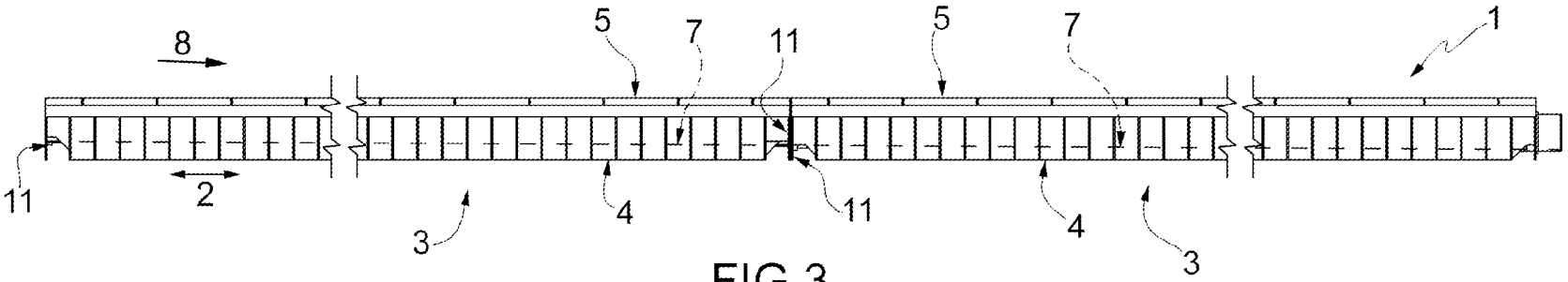
FIG. 3 shows a schematic side view, with parts removed for clarity, of the FIGS. 1 and 2 gutter.

As shown in FIG. 3, wall 7 of each channel 3 extends in a direction 8 sloping towards face 4 at an angle of other than 0° and 180° with respect to direction 2, so that channel 3 slopes as required for the rainwater to flow along gutter 1.

In connection with the above, it should be pointed out that wall 7 of each channel 3 has the same slope as walls 7 of the other channels 3, and is substantially coplanar with wall 7 of each adjacent channel 3, so as to ensure the necessary continuity of gutter 1.

Figure 4:
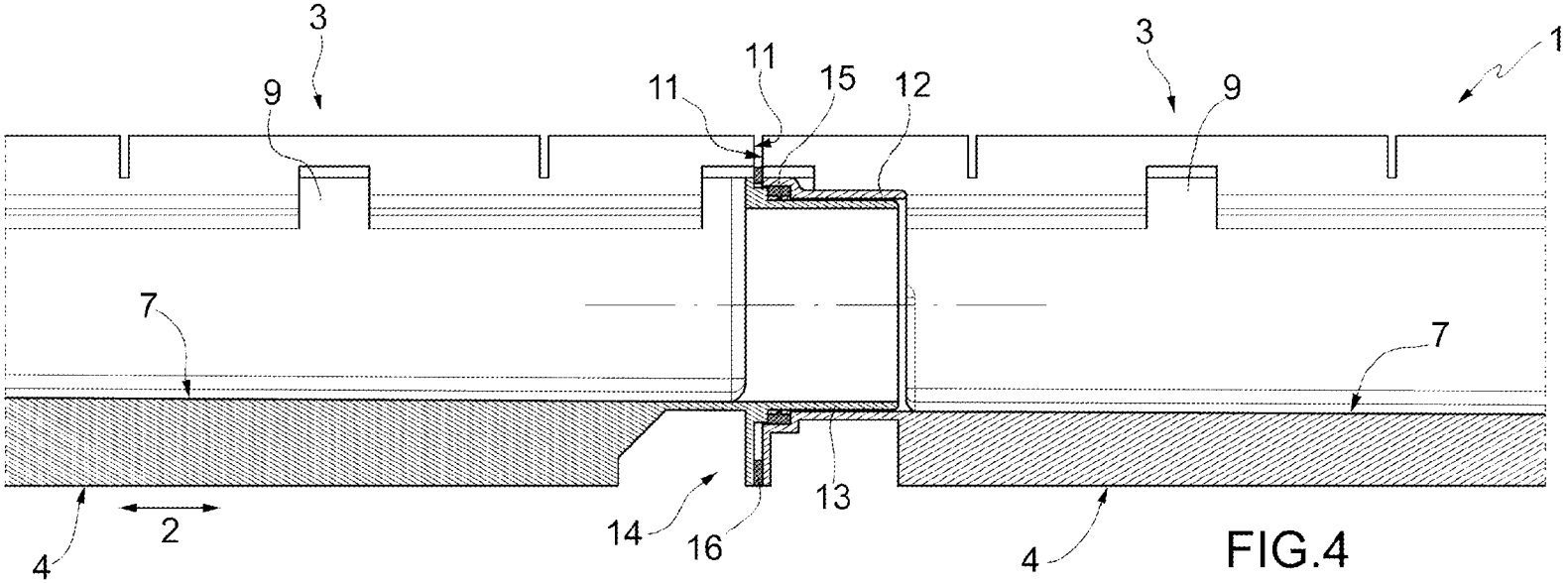
FIG. 4 shows a schematic longitudinal section, with parts removed for clarity, of the FIGS. 1 and 2 gutter.

With reference to FIGS. 1, 2 and 4, each shoulder 6 has a number of substantially L-shaped supporting brackets 9 spaced along the top edge of shoulder 6, in direction 2, and each facing a corresponding bracket 9 on the other shoulder 6.

Brackets 9 on the two shoulders 6 cooperate to support a grille 10 closing the top of channel 3 and located a given distance from the top edge of each shoulder 6 to allow rainwater to fall into channel 3, between shoulders 6 and grille 10.

Each channel 3 is bounded longitudinally by two end faces 11 substantially perpendicular to direction 2, and comprises two sleeves 12, 13, of which sleeve 12 projects into channel 3 from one of faces 11, and sleeve 13 projects outwards of channel 3 from the other face 11.

As shown in FIG. 4, each channel 3 is connected in fluid-tight manner to each adjacent channel 3 by a connecting device 14 comprising sleeve 12 of one channel 3, and sleeve 13 of the other channel 3.

Sleeve 13 is inserted inside sleeve 12, and is connected in fluid-tight manner to sleeve 12 by a first annular seal 15 interposed between sleeves 12, 13 of the two channels 3.

Device 14 also comprises a second annular seal 16, in the form of a closed ring and which extends about sleeve 13.

Seal 16 is fitted between adjacent faces 11 of the two channels 3, and is substantially the same shape and size as faces 11.

Device 14 also comprises two flat, substantially U-shaped reinforcing brackets (not shown) made of metal and located on opposite sides of the two adjacent faces 11 in direction 2.

Finally, device 14 comprises a number of bolts 22 fitted parallel to direction 2 and extending through seal 16 and through respective holes 17 formed in faces 11 and the reinforcing brackets (not shown).

Figure 6:
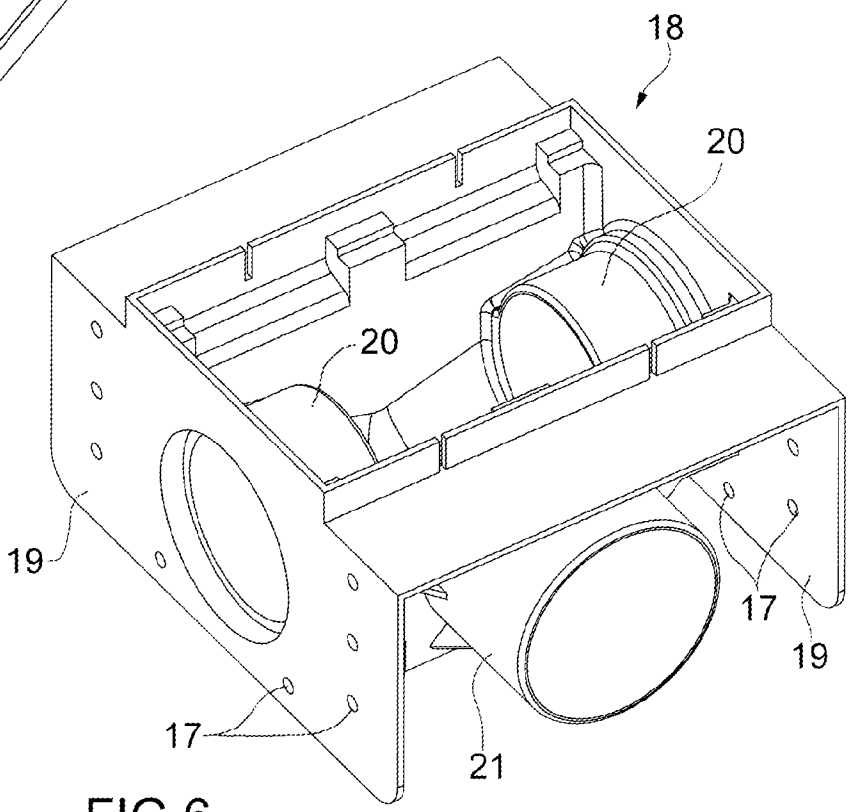
FIG. 6 shows a schematic view in perspective of a manifold for draining the rainwater fed along the FIGS. 1 and 2 gutter.
Figure 5:
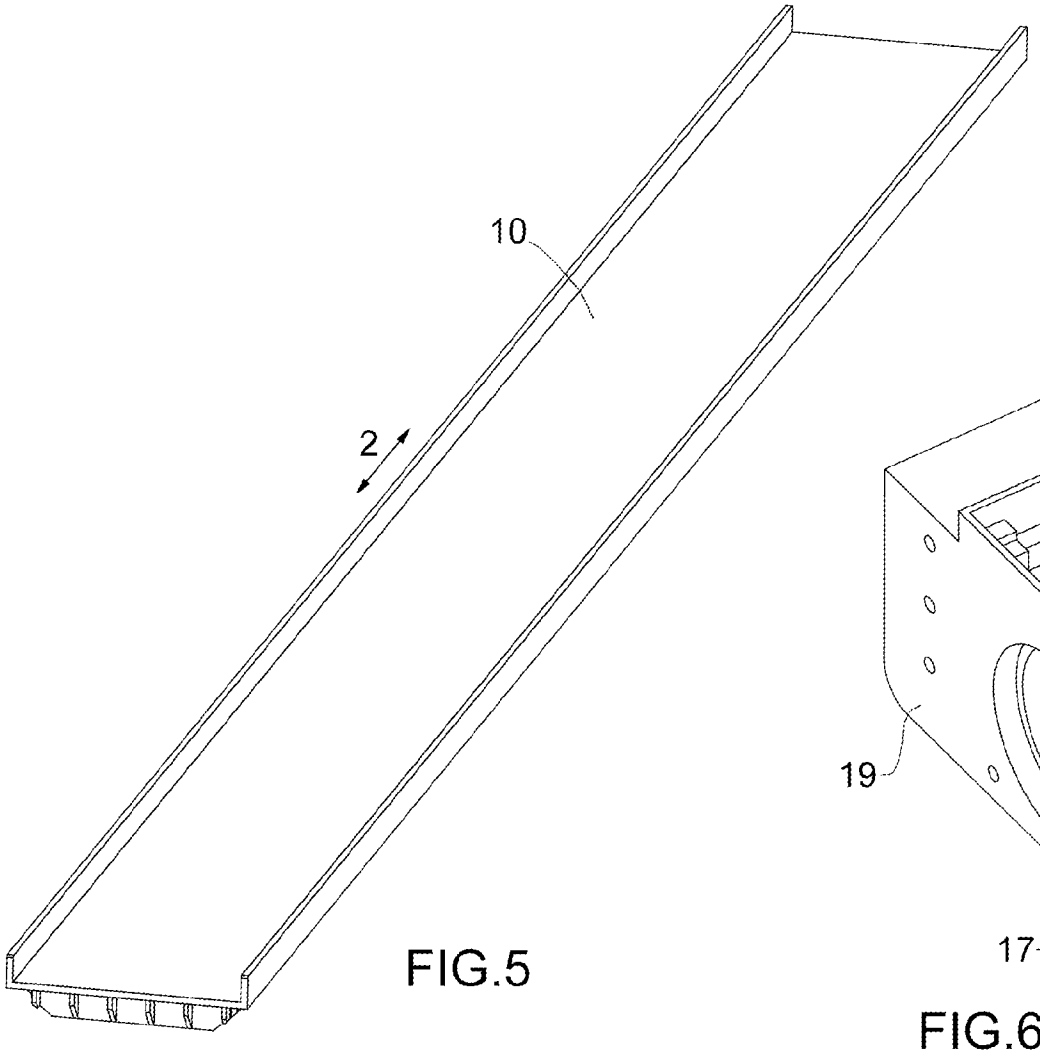
FIG. 5 shows a schematic view in perspective of a top cover grille of the FIGS. 1 and 2 gutter.

With reference to FIG. 6, the rainwater flowing along gutter 1 is drained into a parallelepiped-shaped manifold 18 located between two gutters 1 and bounded by two opposite end faces 19, each of which is connected in fluid-tight manner to face 11 of relative gutter 1, in the same way as faces 11 of two adjacent channels 3.

Manifold 18 comprises two inlet sleeves 20, each of which projects inside manifold 18 from a relative face 19, is substantially coaxial with the other sleeve 20, and is connected in fluid-tight manner to sleeve 13 of relative gutter 1 in the same way as sleeves 12, 13 of two adjacent channels 3.

Manifold 18 also comprises an outlet sleeve 21, which projects outwards of manifold 18, extends in a direction substantially perpendicular to sleeves 20, and drains out of manifold 18 the rainwater fed into manifold 18 by the two gutters 1.

Gutter 1 has several advantages, mainly due to the fact that channels 3 are relatively easy and fast to install, with no additional equipment required, because of the constant height of each channel 3, and the slope of bottom wall 7 of each channel 3 with respect to relative bottom face 4; the connection between sleeves 12, 13 and end faces 11 of each two adjacent channels 3 ensures proper fluid-tight connection of channels 3; and seal 16 being in the form of a closed ring and the same shape and size as faces 11, gutter 1 prevents rainwater from infiltrating beneath the supporting surface of gutter 1.

The invention claimed is:

1. A rainwater gutter comprising at least two channels connected end to end in a first direction, each channel having a supporting bottom face by which to mount the channel on a supporting surface, being bounded internally by a bottom wall defining a rainwater flow bed, and being bounded longitudinally by two end faces substantially parallel to each other and perpendicular to the first direction, each of the two end faces comprising an outer surface; and connecting means for connecting the two channels in fluid-tight manner;

the connecting means comprising a first sleeve projecting inside one of the channels, the outer surface of a first one of the two end faces completely circumscribing an opening into the first sleeve;

a second sleeve projecting outwards of the other channel and inserted inside the first sleeve, the outer surface of a second one of the two end faces completely circumscribing the second sleeve;

a first annular seal interposed between said first and second sleeve;

a second annular seal fitted between the outer surfaces of adjacent end faces of the two channels and completely circumscribing the second sleeve; and fastening means for fastening the adjacent end faces of the two channels one to the other with the interposition of the second annular seal.

2. The gutter as claimed in claim 1, wherein the second annular seal is a flat plate.

3. The gutter as claimed in claim 1, wherein each of the outer surfaces of the two end faces is substantially planar.

4. The gutter as claimed in claim 1, wherein the bottom face of each channel extends parallel to the first direction, and the bottom wall of each channel extends in a second direction sloping at an angle of other than 0° and 180° with respect to the first direction.

5. The gutter as claimed in claim 4, wherein said second direction slopes towards said bottom face.

6. The gutter as claimed in claim 4, wherein the bottom wall of each channel is substantially coplanar with the bottom wall of each adjacent channel.

7. The gutter as claimed in claim 1, wherein the channel has a top face substantially parallel to the bottom face; the distance between said top face and said bottom face, and hence the height of the channel, being substantially constant along the whole length of the channel.

8. The gutter as claimed in claim 1, wherein the channel is made of plastic.

9. The gutter as claimed in claim 1, wherein the second annular seal is in the form of a closed ring that forms a fluid-tight seal about the opening, and extends about said second sleeve.

10. The gutter as claimed in claim 1, wherein the fastening means extend through the second annular seal.

11. The gutter as claimed in claim 1, wherein the second annular seal is substantially the same shape and size as the end faces.

* * * * *